US006383017B1

(12) United States Patent
Takayasu

(10) Patent No.: US 6,383,017 B1
(45) Date of Patent: May 7, 2002

(54) FLEXIBLE BOARD ELECTRICAL CONNECTOR

(75) Inventor: Ryuichi Takayasu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/834,878

(22) Filed: Apr. 16, 2001

(30) Foreign Application Priority Data

Apr. 17, 2000 (JP) ..... 2000-114985

(51) Int. Cl.[7] ..... H01R 12/24
(52) U.S. Cl. ..... 439/495
(58) Field of Search ..... 439/495, 260, 439/67

(56) References Cited

U.S. PATENT DOCUMENTS 5,785,549 A * 7/1998 Takayasu ..... 439/495
5,839,917 A * 11/1998 Takahashi et al. ..... 439/495
5,842,883 A * 12/1998 Igarashi et al. ..... 439/495
6,206,723 B1 * 3/2001 Kunishi ..... 439/495

FOREIGN PATENT DOCUMENTS

JP 9-283235 10/1997

* cited by examiner

*Primary Examiner*—Tho D. Ta
(74) *Attorney, Agent, or Firm*—Kanesaka & Takeuchi

(57) ABSTRACT

A flexible board electrical connector includes first and second terminals (10, 20) each having an upper arm (11, 21) and a pressure member (30) supported by the upper arms (11, 21) at first and second bearing sections (31A, 32A) for rotation. When the pressure member (30) is turned to the closed position, the first and second bearing sections (31A, 32A) are brought into contact with the lower and upper edges of the upper arms (11, 21).

10 Claims, 5 Drawing Sheets

FLEXIBLE BOARD ELECTRICAL CONNECTOR

BACKGROUND OF THE INVENTION

1. Field of the Invention

The present invention relates to electrical connectors for flexible boards.

2. Description of the Related Art

Japanese patent application Kokai No. 9-283235 discloses an electrical connector of this type.

As FIG. 5 shows, this connector comprises a housing 53 and at least one first terminal 51 and at least one second terminal 52, both of which are made by stamping a metal sheet and spaced at intervals in a first direction perpendicular to the picture plane. The first terminal 51 has a support arm 54, a contact arm 55, a fixing arm 56, and a connection leg 57 provided in this order from top. The support arm 54 is made wide and rigid and has a substantially circular bearing section 54A at the front end. The contact arm 55 is made elongated and flexible and has a contact section 55A. The fixing arm 56 has an engaging projection 56A. The connection leg 57 extends through the housing to a circuit board P. The first terminal 51 is inserted into a first slot of the housing 53 from the right, and the engaging projection 56A lock it in place.

The second terminal 52 is identical with the first terminal 51 except that it has no fixing arm 56. It is inserted into the housing 53 from the left, and the connection leg 58 extends to the left. The first and second terminals 51 and 52 are inserted alternately in opposite directions such that the contact sections 55A and 59A are arranged in a zigzag fashion as viewed from the top. The bearing sections 54A of terminals 51 form a shaft that extends in the first direction and supports a pressure member 60 for rotation. The pressure member 60 is turned counterclockwise (F2) at a concave face 61 to a closed position where a pressure section 62 presses a flexible board 70 downwardly. The flexible board 70 has a reinforced section 71 and a circuit section 72 provided on the lower face of the reinforced section 71.

In use, the pressure member 60 is turned clockwise (F1) about the bearing sections 54A so as to provide a large space above the contact arms 55, into which the flexible board 70 is inserted from the left such that the circuit section 72 are placed on the contact sections 55A and 59A.

Then, the pressure member 60 is turned counterclockwise (F2) to the closed position so that the flexible board 70 is pressed down by the pressure section 62 of the pressure member 60, bringing the circuit section 72 into spring contact with the contact sections 55A and 59A for electrical connection.

There is a demand for a low-profile connector for miniaturizing the electronic equipment.

However, the connector has a large number of terminals, and the pressure member has a large width so that when it is turned to the closed position, the reactive force of the terminals warps and disengages the pressure member from the bearing sections. In order to prevent such disengagement, the pressure member has been made thick, resulting in the tall connector.

In addition, the contact sections of the first and second terminals are spaced in the second or horizontal direction so that in order to effectively press the flexible board against both the first and second contact sections, it is desired for the bearing sections to spaced far from the contact sections, leading to the even thicker pressure member.

SUMMARY OF THE INVENTION

Accordingly, it is an object of the invention to provide a low-profile connector with a thin pressure member that is able to effectively press down the flexible board against the first and second terminals spaced apart.

According to one aspect of the invention there is provided a flexible board electrical connector which comprises a housing having an open mouth; at least one first terminal provided in the housing and having an first upper arm and a first lower arm with an upwardly extending first contact section; at least one second terminal provided in the housing and having a second upper arm and a second lower arm with an upwardly extending second contact section; a pressure member having first and second bearing sections that engage lower and upper edges of the first and second upper arms, respectively, for rotation between an open position where a flexible board is inserted through the open mouth such that a circuit face of the flexible board is placed on the first and second contact sections and a closed position where the flexible board is pressed against the first and second contact sections.

Since the pressure member is held between the first and second upper arms of the first and second terminals, it is possible to prevent the thin pressure member from falling from the housing. The first upper arm of the first terminal is made flexible so that it is flexed upwardly by the first bearing section when the pressure member is turned from the open position to the closed position while the pressure member is moved downwardly by a reactive force of the upper arm. Thus, the reactive force moves the pressure member downwardly to press down the flexible board so that the contact pressure for the second terminal is secured.

The upper arm of the second terminal is made flexible so that when the pressure member is moved downwardly, it is flexed downwardly by the second bearing section to thereby press down the flexible board. Consequently, the second upper arm of the second terminal presses down the flexible board so that the flexible board is brought into contact with the first and second contact sections ever if the first and second contact sections are spaced apart in the flexible board insertion/removal direction. The upper and lower arms of the second terminal are joined together by a linking section from which an engaging projection extends and engages an engaging hole of the housing with a play so that a part of the lower arm is flexed when the upper arm is flexed. This increases the degree of flexure and reduces the height of a connector.

The first and second contact sections of the first and second terminals are spaced apart in the flexible board insertion/removal direction. The distance between a center of rotation and a contact point between the pressure member and the flexible board becomes smallest at the closed position of the pressure member, keeping the pressure member at the closed position against the reactive force of the terminals, preventing the pressure member from falling by the reactive force.

When the pressure member is turned to the open position, at least one of the first and second bearing sections flexes upwardly the first and second upper arms of the first and second terminals to thereby increase a distance between the upper and lower arms. Consequently, the flexible board can be inserted into or removed from the housing with a zero insertion/removal force.

According to another aspect of the invention there is provided a flexible board electrical connector, wherein the upper and lower arms of the second terminal are joined together by a linking section from which an engaging projection extends and engages an engaging hole of the housing with a play so that a part of the lower arm is flexed when the upper arm is flexed.

Since both the upper arm and a part of the lower arm are flexed, a large amount of flexure is obtained, making it possible to reduce the height of the connector by that much.

According to still another aspect of the invention there is provided a flexible board electrical connector which, unlike the first and second terminals according to the first and second aspects of the invention, comprises a single type of terminals that hold the pressure member between them at the closed position, thereby producing the same results. The pressure member having first and second bearing sections that engages lower and upper edges of the upper arms for rotation.

According to the fourth aspect of the invention, a single type of terminals enables to insert or remove the flexible board with a zero-insertion/removal force.

According to the fourth aspect of the invention there is provided a flexible board electrical connector which comprises a pressure member having at least one bearing section that engages lower edge of the upper arm for rotation to flex upwardly the upper arm, making a distance between the upper and lower arms largest at the open position.

BRIEF DESCRIPTION OF THE DRAWINGS

FIGS. 1(B)-1 through 1(B)-3 are sectional views taken along the second terminal of the connector;

FIGS. 2(A)-1 through 2(A)-3 are sectional views taken along the first terminal of a connector according to the second embodiment of the invention;

FIGS. 2(B)-1 through 2(B)-3 are sectional views taken along the second terminal of the connector according to the second embodiment;

FIGS. 3(A)-1 through 3(A)-3 are sectional views taken along the first terminal of a connector according to the third embodiment of the invention;

FIGS. 3(B)-1 through 3(B)-3 are sectional views taken along the second terminal of the connector according to the third embodiment;

FIGS. 4(A)-1 through 4(A)-3 are sectional views taken along the first terminal of a connector according to the fourth embodiment of the invention;

FIGS. 4(B)-1 through 4(B)-3 are sectional views taken along the second terminal of the connector according to the fourth embodiment of the invention.

DESCRIPTION OF THE PREFERRED EMBODIMENT

Figures 1, 1B:
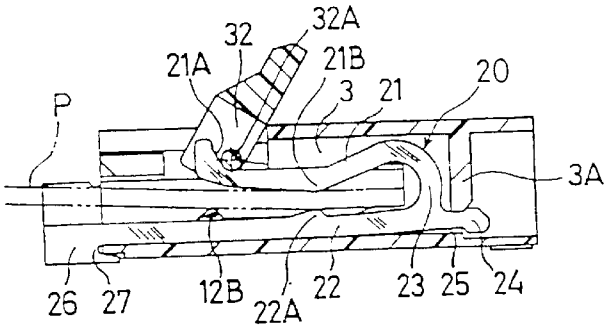

Embodiments of the invention will now be described with reference to FIGS. 1–4.

In FIGS. 1(A)-1 through 1(B)-3, a connector according to the first embodiment of the invention has first and second terminals 10 and 20. The connector comprises a housing 1 that is made of an insulative material so as to extend in the first direction perpendicular to the picture plane. The housing 1 has first and second receiving slots 2 and 3 for receiving the first and second terminals 10 and 20. The first and second receiving slots 2 and 3 extend in respective planes parallel to the picture plane and are spaced alternately in the first direction. They have engaging walls 2A and 3A, respectively, for locking the first and second terminals 10 and 20 therein. They communicate with each other at the upper left corners to form an open mouth 4. The first and second terminal 10 or 20 is made by stamping a metal sheet so as to provide an upper arm 11 or 21, a lower arm 12 or 22, and a linking section 13 or 23 for joining them together.

Figures 1, 1B, 2:
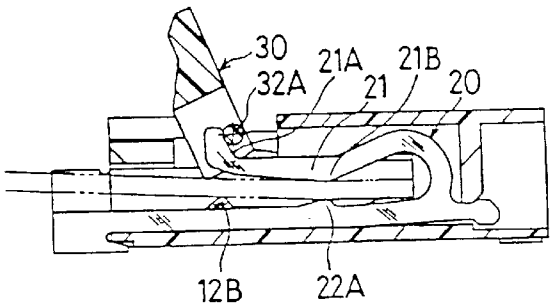
Figures 1, 1B, 2, 3:
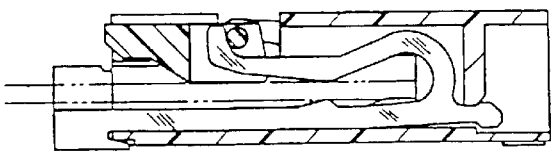
Figures 1, 1A:
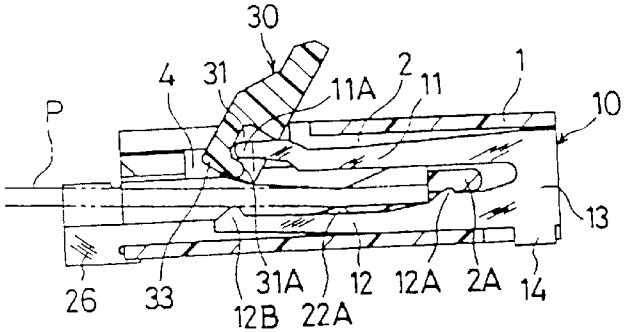
FIGS. 1(A)-1 through 1(A)-3 are sectional views taken along the first terminal of a connector according to the first embodiment of the invention.
Figures 1, 1A, 2:
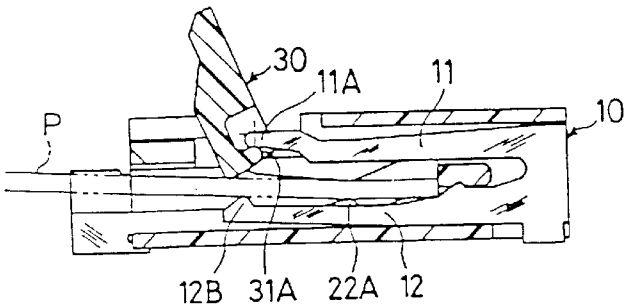
Figures 1, 1A, 2, 3:
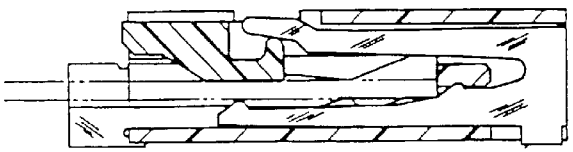

As best shown in FIG. 1(A)-1, the first terminal 10 is inserted into the first receiving slot 2 from the right such that a projection 12A of the lower arm 12 engages the engaging wall 2A to lock the first terminal 10. A connection leg 14 extends downwardly from the linking section 13. The upper arm 11 is vertically flexible, and a guiding finger 11A is provided in the open mouth 4 and has a circular tip for guiding a pressure member 30. A contact section 12B is provided on the upper front edge of the lower arm 12 in front of the guiding finger 11A.

As best shown in FIG. 1(B)-1, the second terminal 20 is inserted in the second receiving slot 3 from the left. An engaging section 24 extends from the bottom of the linking section 23 such that the head portion engages the engaging wall 3A to lock the second terminal 20. A space 25 is provided between the linking section 23 and the bottom of the housing 1.

The upper arm 21 extends forwardly and then upwardly to form an inclined section 21A. Similarly to the upper arm 11, it is vertically flexible. Since there is the space 25 and the engaging section 24 engages the engaging wall 3A with a little play, it is flexible in a wide range reaching the lower arm 22. A contact section 22A is provided on upper edge of the lower arm 22 behind the inclined section 21A and spaced from the contact section 12B of the first terminal 10. It is opposed to a curved section 21B of the upper arm 21 to form a narrow space between the upper and lower arms 21 and 22. A recess 27 at the left portion of the lower arm 22 engages the housing 1 to lock the second terminal 20 and forms a connection leg 26.

The pressure member 30 is provided at the open mouth 4 where the first and second terminals 20 and 30 are provided alternately. Similarly to the housing 1, it is made of an insulative material and supported by the guiding fingers 11A and the inclined section 21A of the upper arms 11 and 21, respectively, for rotation. It has first and second slots 31 and 32 at positions corresponding to the first and second terminals 10 and 20. The first slot 31 for the first terminal 10 has a U-shaped form to provide a first bearing section 31A that is supported by the guiding finger 11A for rotation. The second slot 32 for the second terminal 30 has a second bearing section 32A that has a cylindrical form and is in contact with the inclined section 21A of the upper arm 21.

Thus, the first and second bearing sections 32A and 32A of the pressure member 30 are in contact with the lower edge of the guiding finger 11A and the upper edge of the inclined section 21A of the first and second terminals 10 and 20, respectively, for rotation. The pressure member 30 has a pressure edge 33 at such a position that the distance between the pressure edge 33 and the center of rotation is greater than the distance between the center of rotation and the contact face that is in contact with a flexible board.

How to use the connector will be described below.

(1) The connector is placed on a circuit board (not shown) and the connection legs 14 and 26 of the first and second terminals 10 and 20 are soldered to the corresponding circuit traces.

(2) Then, the pressure member 30 is brought into the open position (FIGS. 1(A)-1 and 1(B)-1).

(3) Then, a flexible board P is inserted into the open mouth 4 such that the connection traces on the lower face of the flexible board P are brought to positions above the contact sections 12B and 22A of the first and second terminals 10 and 20, respectively.

(4) Then, as shown in FIGS. 1(A)-2 and 1(B)-2, the pressure member 30 is turned counterclockwise with the first and second bearing sections 31A and 32A in contact with the guiding finger 11A and the inclined section 21A of the first and second terminals 10 and 20, respectively. That is, the pressure member 30 is supported and guided between the lower and upper edges of the first and second terminals 10 and 20, respectively, for rotation. Where the guiding finger 11A and the inclined section 21A receive pressures from the first and second bearing sections 31A and 32A, the upper arms 11 and 21 are flexed so that the center of rotation moves. When the pressure member 30 presses down the flexible board P at the pressure section 33 against the contact section 12B, it receives a reactive force at the first bearing section 31A from the guiding finger 11A of the first terminal 10, tending to lower the center of rotation. This tends to press down the upper arm 21 of the second terminals 20 by the second bearing section 32A at the inclined section 21A. Consequently, the upper arm 21 presses down the flexible board P against the contact section 22A at the curved section 21B with a high contact pressure.

(5) Under these conditions, the pressure member 30 is further turned into the closed position (FIGS. 1(A)-3 and 1(B)-3), where the flexible board P is kept in contact with the contact sections 12B and 22A of the first and second terminals 10 and 20 under satisfactory contact pressures.

Since it is held between the upper arms 11 and 21 of the first and second terminals 10 and 20, the pressure member 30 does not fall from the housing 1 even if it is made thin and flexible. Consequently, the connector is made thin or of low-profile.

In FIGS. 2(A)-1 through 2(B)-3, according to the second embodiment, prevention of the pressure member 30 from falling from the housing 1 is improved. The first bearing section 34 of the second embodiment is different from that of the first embodiment. The second bearing section 35 looks different from that of the first embodiment but is not substantially different from the first embodiment in terms of functions.

Figures 1, 2B:
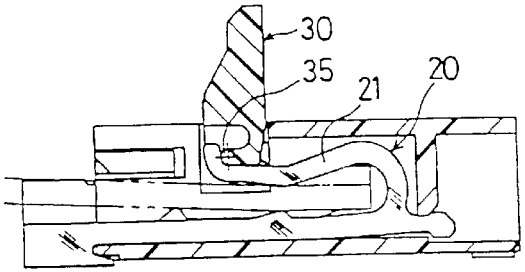
Figures 2, 2B:
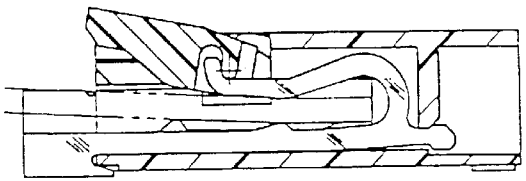
Figures 2, 2B, 3:
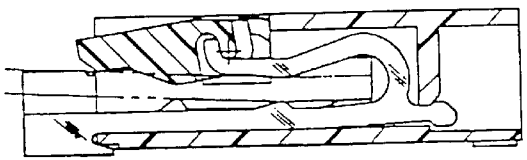
Figures 1, 2A:
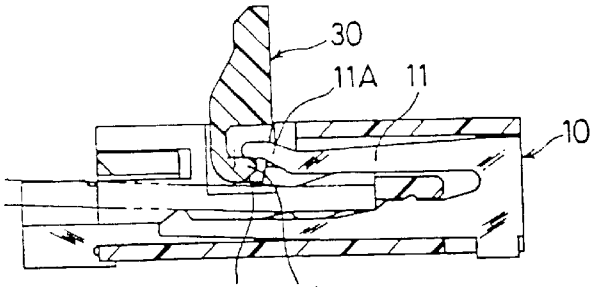
Figures 2, 2A:
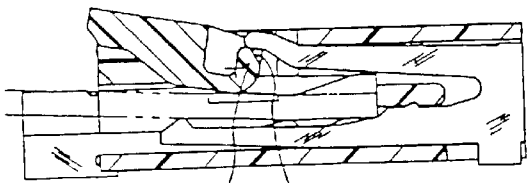
Figures 2, 2A, 3:
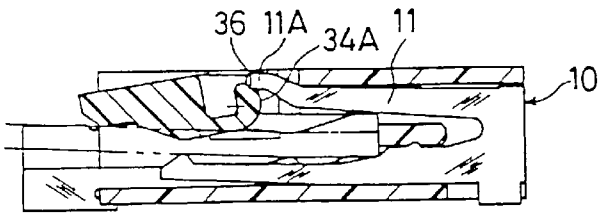

In FIG. 2(A)-1, the first bearing section 34 has an inclined portion 34A such that when the pressure member 30 is at the closed position (FIG. 2(A)-3), the inclined portion 34A is brought into contact with the finger portion 11A at a contact point 36, with the shortest distance between the center of rotation and the contact point 36. Thus, even if an external force is applied to the pressure member 30, a recovering torque keeps the pressure member 30 in the stable closed condition, preventing the pressure member 30 from rotating toward the open position and falling from the housing.

In FIGS. 3(A)-1 through 3(B)-3, this third embodiment is characterized in that when the pressure member 30 is at the open position, the flexible board can be inserted or removed with a low resistance; that is, a low- or zero-insertion/removal force.

Figures 1, 3B:
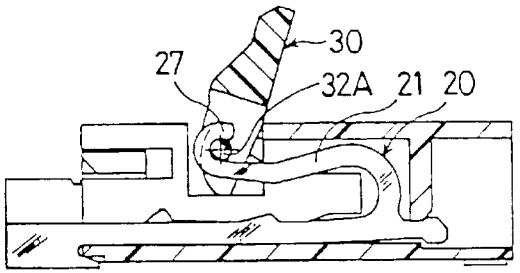
Figures 2, 3B:
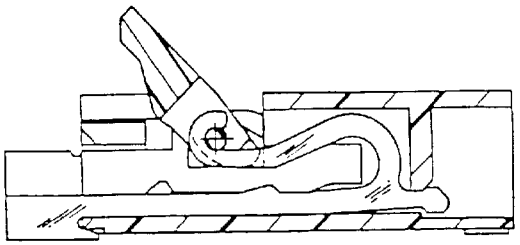
Figures 3, 3B:
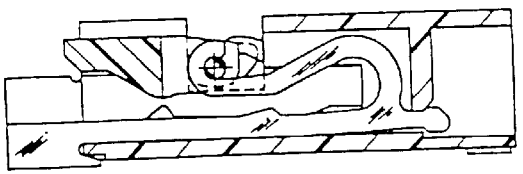
Figures 1, 3A:
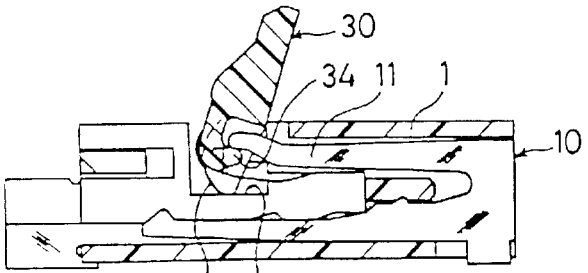
Figures 2, 3A:
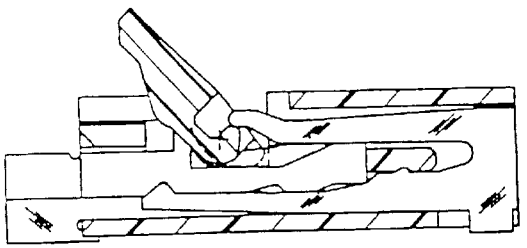
Figures 3, 3A:
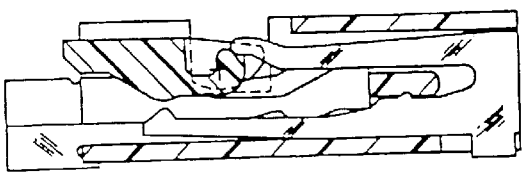

In FIG. 3(A)-1, the first bearing section 34 and the upper arm 11 of a first terminal 10 are the same as those of FIG. 2(A)-1. The second bearing section 32A is the same as that of FIG. 1(B)-1 except that the upper arm 20 has a curved engaging section 27 at the front end. The pressure member 30 has a pair of cam sections 37 at opposite ends between which there are neither first nor second bearing sections 34 and 32A. The cam sections 37 are supported by support faces 1A of the housing 1 and have a cam radius (between the center of rotation and the cam face) that is the largest at the open position (FIGS. 3(A)-1 and 3(B)-1) and the smallest at the closed position (FIGS. 3(A)-3 and 3(B)-3). Consequently, when the pressure member 30 is at the open position, the upper arms 11 and 21 of the first and second terminals 10 and 20 are flexed upwardly by the first and second bearing sections 34 and 32A and moved away from the lower arms 12 and 22 so that low- or zero-force insertion/removal is realized. When the pressure member 30 is brought to the closed position through the conditions of FIGS. 3(A)-2 and 3(B)-2, the cam radius becomes the smallest so that the recovery forces of the upper arms 11 and 21 bring the flexible board into contact with the contact sections 12B and 22A under a predetermined pressure. That is, even if the pressure member 30 is made thin, it is possible to secure the contact pressure upon the contact sections 12B and 22A that are spaced from the pressure member 30.

In FIGS. 4(A)-1 through 4(B)-3, the fourth embodiment is characterized in that only a single type of terminals are used in contrast to the two types of terminals used in the above embodiments.

Figures 1, 4B:
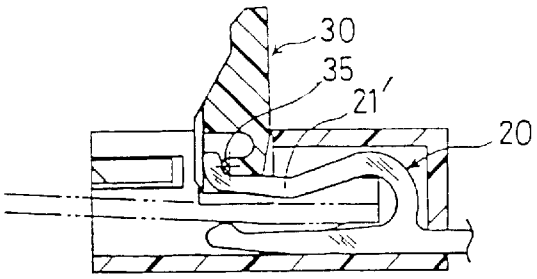
Figures 2, 4B:
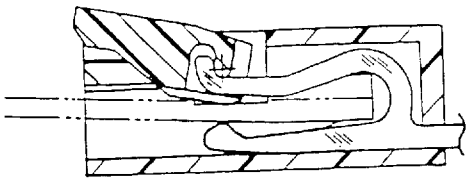
Figures 3, 4B:
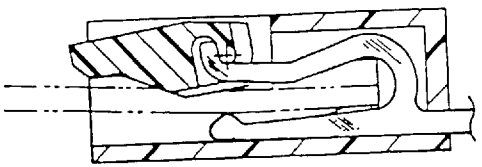
Figures 1, 4A:
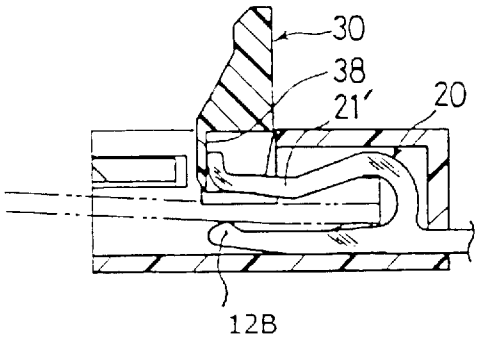
Figures 2, 4A:
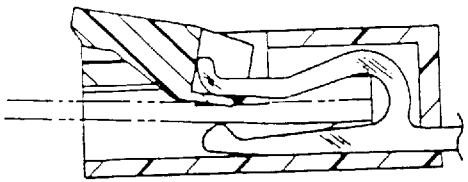
Figures 3, 4A:
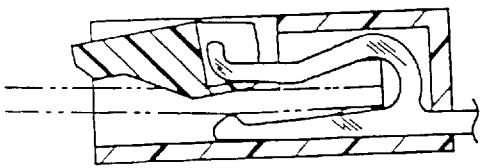
Figure 5:
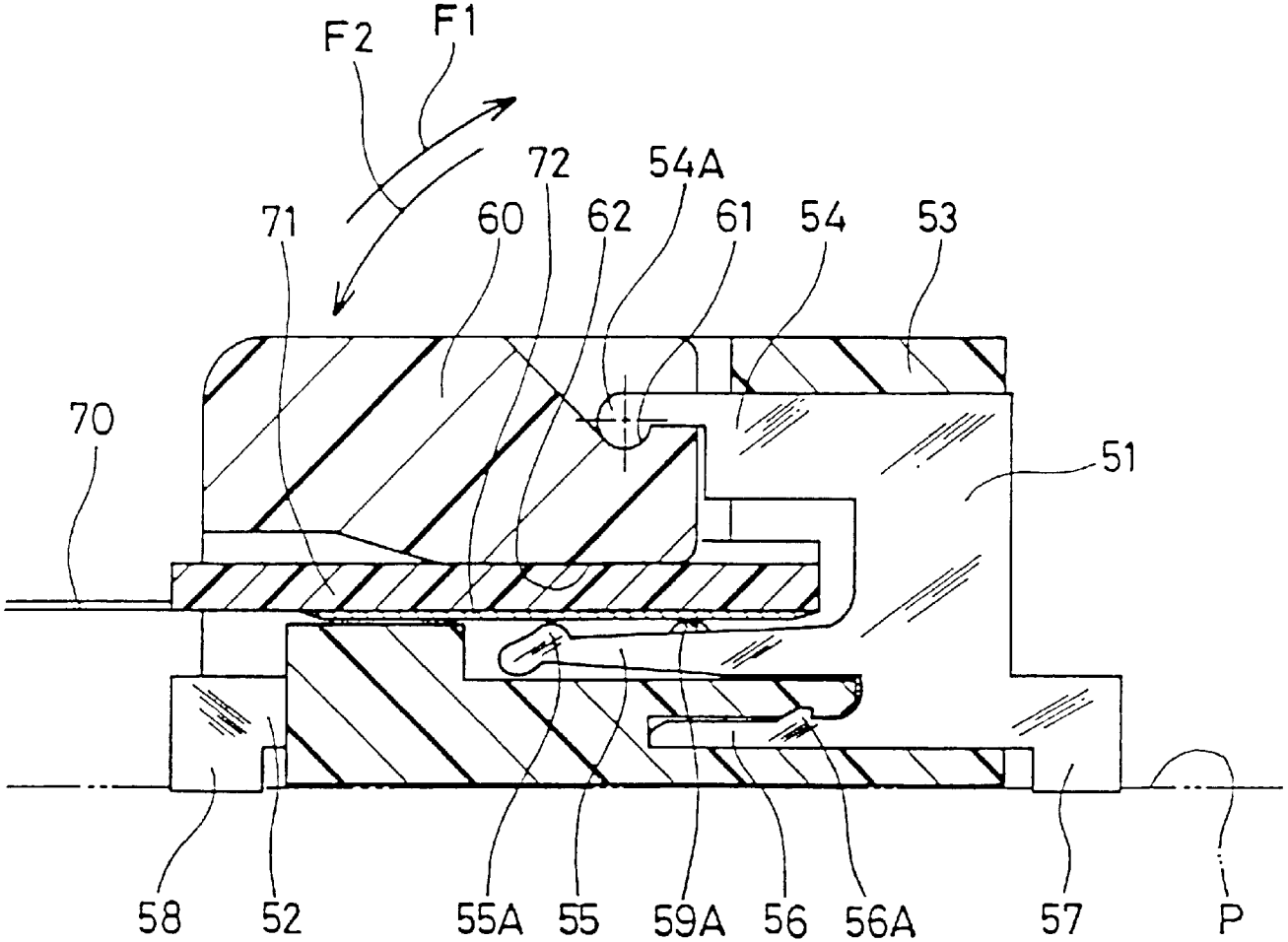
FIG. 5 PRIOR ART
FIG. 5 is a sectional view of a conventional connector.

The pressure member 30 has two sorts of bearing sections. One of the bearing sections is the same as the second bearing section 35 of FIG. 2(B)-1. As best shown in FIG. 4(B)-1, the second bearing section 35 extends toward the right from the left side wall of the pressure member 30 at the open position. As best shown in FIG. 4(A)-1, the other or first bearing section 38 extends toward the left from the right side wall of the pressure member 30 at the open position. The pressure member 30 is supported from above at the first bearing section 38 and from below at the second bearing section 35, producing the same effects as in the first embodiment.

In the above embodiments, the circuit board is provided in the horizontal direction but, where the circuit board is provided in the vertical direction, the vertical direction in the above embodiments becomes the horizontal direction. The connection circuits may be provided on opposite faces of a flexible board, and the curved sections 21B of FIG. 1(B)-1 may be made contact section 21'.

As has been described above, according to the invention, the bearing section of the pressure member is supported between the upper arms of the first and second terminals at the closed position so that it is possible to prevent separation of the thin pressure member by reactive forces of the terminals, making a low-profile connector possible. Where the first terminal causes the pressure member to press the flexible board against the second terminal, it is possible to press the flexible board against both of the spaced-apart contact sections without increasing the thickness of the pressure member.

What is claimed is:

1. A flexible board electrical connector comprising:

a housing having an open mouth;

at least one first terminal provided in said housing and having a first upper arm and a first lower arm with an upwardly extending first contact section;

at least one second terminal provided in said housing and having a second upper arm and a second lower arm with an upwardly extending second contact section;

a pressure member having first and second bearing sections that engage lower and upper edges of said first and second upper arms, respectively, for rotation between an open position where a flexible board is inserted through said open mouth such that a circuit face of said flexible board is placed on said first and second contact sections and a closed position where said flexible board is pressed against said first and second contact sections.

2. The flexible board electrical connector according to claim 1, wherein said first and second contact sections of said first and second terminals are spaced apart in a flexible board insertion/removal direction.

3. The flexible board electrical connector according to claim 1, wherein a distance between a center of rotation and a contact point between said pressure member and said flexible board becomes smallest at said closed position of said pressure member.

4. The flexible board electrical connector according to claim 1, wherein when said pressure member is turned to said open position, at least one of said first and second bearing sections flexes upwardly said first and second upper arms of said first and second terminals to thereby increase a distance between said upper and lower arms.

5. The flexible board electrical connector according to claim 1, wherein said first upper arm of said first terminal is flexible so that it is flexed upwardly by said first bearing section when said pressure member is turned from said open position to said closed position while said pressure member is moved downwardly by a reactive force of said first upper arm.

6. The flexible board electrical connector according to claim 5, wherein said upper arm of said second terminal is flexible so that when said pressure member is moved downwardly, it is flexed downwardly by said second bearing section to thereby press down said flexible board.

7. The flexible board electrical connector according to claim 6, wherein said upper and lower arms of said second terminal are joined together by a linking section from which an engaging projection extends and engages an engaging hole of said housing with a play so that a part of said lower arm is flexed when said upper arm is flexed.

8. A flexible board electrical connector comprising:

a housing having an open mouth;

at least one first terminal provided in said housing and having a first upper arm and a first lower arm with an upwardly extending first contact section;

at least one second terminal provided in said housing and having a second upper arm and a second lower arm with an upwardly extending second contact section; a pressure member having first and second bearing sections that engages lower and upper edges of said first and second upper arms, respectively, for rotation between an open position where a flexible board is inserted into said housing through said open mouth and a closed position where said flexible board is pressed against said first and second contact sections by said pressure member, wherein said upper and lower arms of said second terminal are joined together by a linking section from which an engaging projection extends and engages an engaging hole of said housing with a play so that a part of said lower arm is flexed when said upper arm is flexed.

9. A flexible board electrical connector comprising:

a housing having an open mouth;

a plurality of terminals provided in said housing and each having an upper arm extending forwardly into said open mouth and a lower arm extending forwardly, at least one contact section provided on either said upper or lower arm;

a pressure member having first and second bearing sections that engages lower and upper edges of said upper arms, respectively, for rotation between an open position where a flexible board is inserted into said housing through said open mouth such that a circuit face of said flexible board faces said contact sections and a closed position where said flexible board is pressed against said contact sections by said pressure member.

10. A flexible board electrical connector comprising:

a housing having an open mouth;

a plurality of terminals provided in said housing and each having an upper arm and a lower arm;

at least one contact section provided on either said upper or lower arm;

a pressure member having at least one bearing section that engages a lower edge of one of said upper arms for rotation between an open position where a flexible board is inserted into said housing through said open mouth and a closed position where said flexible board is pressed against said contact section; and a pair of cam sections provided on opposite sides of said pressure member to flex upwardly said upper arms with respect to said housing, making a distance between said upper and lower arms largest at said open position.

* * * * *